US006359265B1

(12) United States Patent
Fe

(10) Patent No.: US 6,359,265 B1
(45) Date of Patent: Mar. 19, 2002

(54) HEATED GLASS GUARD WITH ELECTRONIC CONTROL FOR FORKLIFT TRUCKS

(75) Inventor: Ming L. Fe, Ithaca, NY (US)

(73) Assignee: The Raymond Corporation, Greene, NY (US)

( * ) Notice: Subject to any disclaimer, the term of this patent is extended or adjusted under 35 U.S.C. 154(b) by 0 days.

(21) Appl. No.: 09/681,162

(22) Filed: Feb. 5, 2001

(51) Int. Cl.[7] ..... H05B 1/02

(52) U.S. Cl. ..... 219/497; 219/203; 219/501; 219/505; 52/171.2

(58) Field of Search ..... 219/494, 481, 219/501, 505, 497, 202, 203, 508; 52/171.2; 340/602

(56) References Cited

U.S. PATENT DOCUMENTS 2,557,905 A * 6/1951 Burton et al. ..... 219/202
3,749,885 A 7/1973 Nagasima
3,790,745 A 2/1974 Levin
3,868,492 A 2/1975 Taylor
3,898,423 A 8/1975 Taylor et al.
3,934,111 A * 1/1976 Roselli et al. ..... 219/203
4,357,524 A 11/1982 Apfelbeck et al.

* cited by examiner

*Primary Examiner*—Mark Paschall
(74) *Attorney, Agent, or Firm*—Quarles & Brady LLP

(57) ABSTRACT

An open forklift truck is provided having an elongated windshield that protects the operator from wind chills experienced when operating the truck in a cold storage environment. The windshield is a laminate having a plurality of heating elements disposed therein that are electrically connected to a control and are energized when the windshield falls below a predetermined temperature to prevent condensation from accumulating on the windshield when the truck is moved into a warmer environment. Accordingly, both sides of the windshield are maintained at a temperature greater than the dew point of the warmer environment.

15 Claims, 2 Drawing Sheets

HEATED GLASS GUARD WITH ELECTRONIC CONTROL FOR FORKLIFT TRUCKS

CROSS REFERENCE TO RELATED APPLICATIONS

NA

FEDERAL RESEARCH STATEMENT

NA

BACKGROUND OF INVENTION

The present invention relates to forklift trucks, and in particular, relates to an improved method and apparatus for preventing fog and condensation from accumulating on a windshield of a forklift truck that traverses between environments having varying temperatures.

When operating a forklift vehicle at high speeds in cold storage environments, whose temperatures can typically reach as low as −25° F., a significant wind chill is experienced by the operator, thereby causing discomfort. It is therefore desirable to install a windshield in the truck that will protect the operator from the winds associated with operation of the forklift truck in the cold environment and reduce operator discomfort.

However, because forklift trucks typically traverse between cold storage applications and warm environments, the windshield may experience significant temperature differentials of more than 100° F. Moreover, due to the cold air flow within the cold storage application, various locations on the windshield may be colder than others. Additionally, because the temperature of the cold storage application is commonly less than the dew point of the warmer environment, condensation will accumulate on the windshield when the truck travels from the cold storage application into the warmer environment, thereby obstructing the operator's view. Subsequently, when the truck travels back into the cold environment, the condensation will freeze on the windshield, thereby further obstructing the operator's view, and in most cases rendering the forklift truck unavailable for an extended amount of time.

As a result of the significant drawbacks currently associated with installing a windshield on forklift trucks that traverse between environments having significantly varying temperatures, a wire mesh is conventionally used in place of a windshield so as to prevent condensation from obstructing the operator's view. However, the wire mesh inadequately shields the operator from the potentially severe wind chills that are produced during operation of the forklift truck. Additionally, the wire mesh introduces partial obstruction of the view of the operator. It is therefore desirable to provide a heated windshield assembly, thereby avoiding the disadvantages associated with the wire mesh.

Conventional heated windshield assemblies supply heat to a window having only one surface exposed to the ambient environment, with the other surface disposed within a heated enclosure, such as the interior of a vehicle. Accordingly, in these devices, it is not necessary or desirable to maintain the inner and outer surfaces of the window at substantially the same temperature. Rather, it is only necessary to heat the outer surface of the window that is exposed to the ambient environment. As a result, if such assemblies were to be installed onto an open forklift truck, having both surfaces of the windshield exposed to the ambient environment, only one surface would be protected from condensation. This would inadequately protect the windshield from condensing when the truck travels into the warmer environment, and subsequently freezing when the truck travels back into the cold storage application.

What is therefore needed is a method and apparatus for supplying heat equally to both sides of a windshield assembly and to ensure that condensation does not accumulate thereon when the truck traverses between cold and warm environments.

SUMMARY OF INVENTION

In accordance with a first aspect of the invention, a windshield member is mounted to a vehicle having first and second surfaces exposed to the ambient environment, wherein the first surface faces an operator console and the second surface faces away from the operator console, a heating assembly disposed within the windshield member and configured to supply heat thereto, a first temperature sensor mounted onto the windshield member at a first location and being operable to output a first temperature signal indicating the temperature thereof, a second temperature sensor mounted on to the windshield member at a second location different than the first location and being operable to output a second temperature signal indicating the temperature thereof, and a controller in electrical communication with the heating elements and the first and second temperature sensors and being operable to supply electrical power to the heating assembly when the either sensor indicates a temperature that is below a predetermined temperature level.

In accordance with another aspect of the invention, the predetermined threshold temperature is chosen to be above the dew point of the second location. The present inventor has recognized that heating elements may be installed in a transparent windshield of an open vehicle to maintain the windshield at a predetermined temperature relative to the dew point of the outside or other warm environment to prevent condensation from accumulating on the windshield, and to reduce the wind chill that is typically experienced by the operator of the vehicle. Accordingly, when the vehicle is moved from the cold environment into the warmer environment, condensation will not accumulate on the windshield, thereby preserving the operator's field of view.

These as well as other features and characteristics of the present invention will be apparent from the description which follows. In the detailed description below, preferred embodiments of the invention will be described with reference to the accompanying drawings. These embodiments do not represent the full scope of the invention. Rather the invention may be employed in other embodiments, and reference should therefore be made to the claims herein for interpreting the breadth of the invention.

BRIEF DESCRIPTION OF DRAWINGS

Reference is hereby made to the following figures in which like reference numerals correspond to like elements throughout and in which.

DETAILED DESCRIPTION

Figure 1:
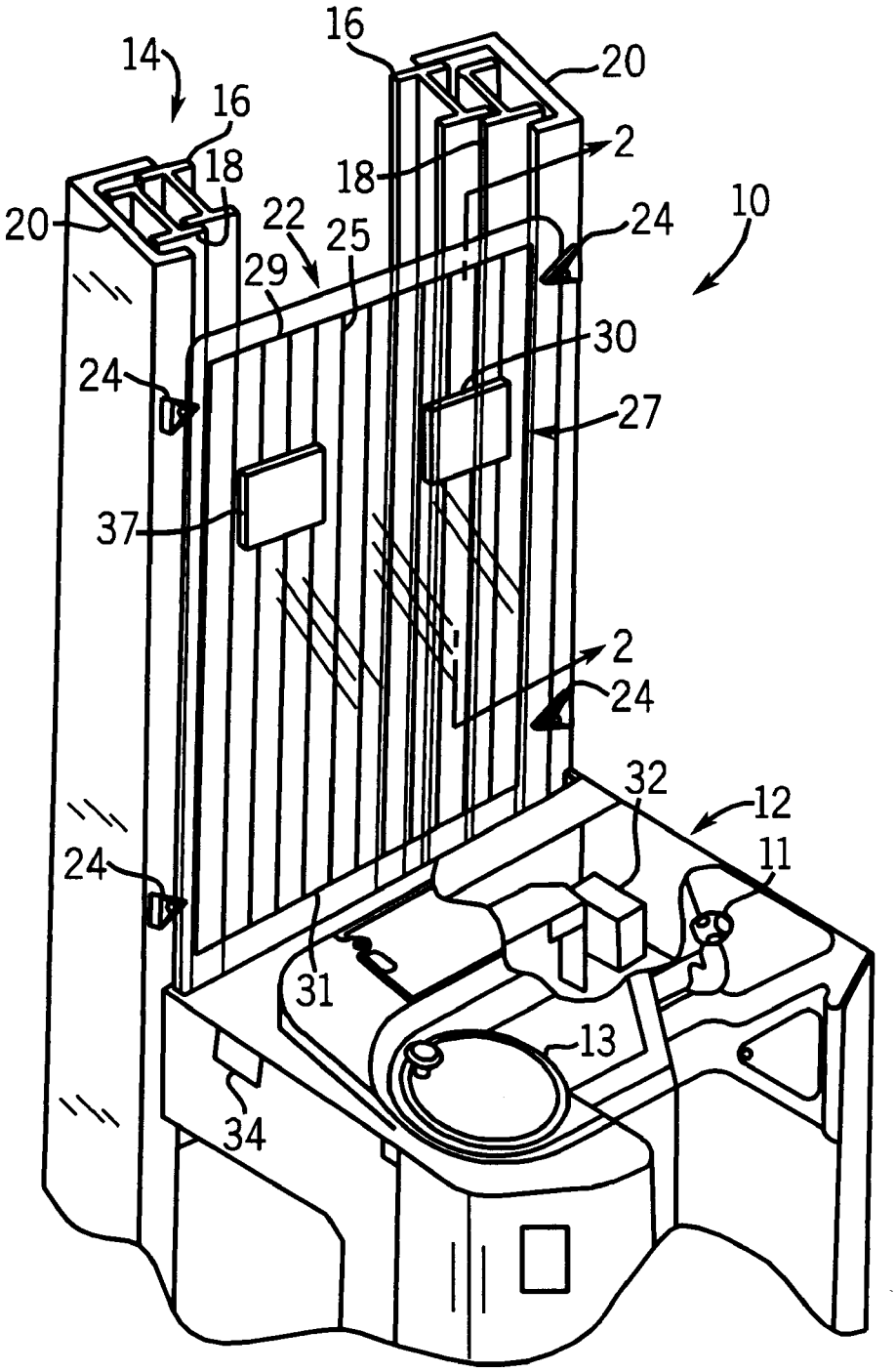
FIG. 1 is a perspective view of a portion of a forklift truck employing the temperature control system of the preferred embodiment with a section of the operator console cut away.

Referring initially to FIG. 1, a portion of an open forklift truck 10 is illustrated having an operator console 12 and a telescoping assembly 14 that supports the forklift (not shown). The telescoping assembly 14 includes a pair of elongated I-beams 16 that are supported in a vertical orientation by elongated beams 18 and 20.

The forklift truck 10 operates under a plurality of controls located on the operator console 12, including an array of four-way switch, reach/retract, switches, horn switch, fingertip actuated control handle 11 and a steering column 13. The control handle 11 provides an independent electrical position signal to control a respective one of the lift/lower, reach/retract, tilt and side shift functions of the forks by means of working hydraulics fitted to the truck. The control handles also control the travel speed of forks first and forks trailing. Although control handles 11 are illustrated in accordance with the preferred embodiment, it should be appreciated that any suitable alternative control apparatus could be used that is capable of producing a desired response. The use of control handles 11 are preferred because they require less operator effort than conventional hydraulic levers and facilitate longer working periods involving complex maneuvers without unduly tiring the operator. The steering column controls the orientation of the forklift truck 10. During operation of the truck 10, the operator is typically positioned immediately behind the operator console 12, to allow for easy access to the controls, and between the I-beams 16, 18, 20 at various lifting stages to maximize his or her field of vision. The forklift truck 10 is, of course, mobile and suitable for use in cold storage applications typically having a temperature as low as −25° F. or, in some cases, even lower.

The truck 10 includes a windshield assembly 22 that is secured by a plurality of brackets 24 that are mounted onto the beams 20 in an overlapping relationship with the windshield assembly. The windshield assembly 22 has an extended height sufficient to significantly reduce the wind chill effect that is experienced by the operator during operation of the forklift truck 10 at high speeds in the cold storage environment.

Figure 2:
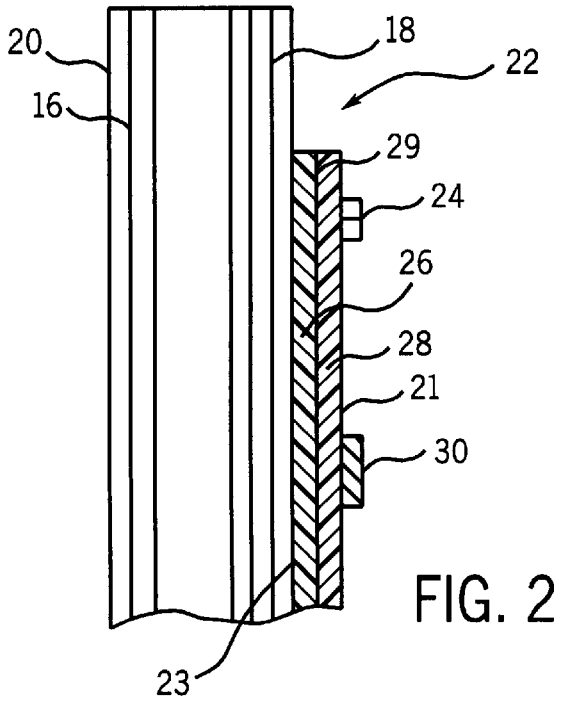
FIG. 2 is a sectional side elevation view taken along 2—2 of FIG. 1.

Referring now also to FIG. 2, the windshield assembly 22 is a laminate that includes first and second layers of tempered glass 28 and 26 having an inner surface 21 and an outer surface 23, respectively. Because the forklift truck 10 is an open vehicle, both surfaces 21 and 23 are exposed to the ambient environment and are capable of producing condensation when the truck 10 travels from the cold storage application to the warmer environment. It should be appreciated that the windshield assembly could comprise any alternative suitable material that is readily heated, and that is adequately transparent such that the operator's vision is unobstructed.

As shown in FIG. 1, a heating assembly 27 includes a plurality of thin elongated heating copper wires 25 that are sandwiched between the two layers of glass 26 and 28. The wires 25 extend vertically and are spaced equidistantly apart across the entire width of the windshield assembly 22. Each wire 25 is connected at its top end to a bus bar 29, formed from tinned copper foil, that extends across the top of the windshield assembly 22. A similar bus bar 31 that extends across the bottom of the windshield assembly 22 is connected to the wires 25 at their lower ends. The wires 25 and bus bars 29 and 31 may be formed from any suitable conductive material. Because the wires 25 are embedded within the windshield assembly 22, they are capable of maintaining the temperature of both surfaces 21 and 23 greater than the dew point of the warmer environment. Additionally, because the wires 25 are preferably disposed equidistantly between the inner and outer surfaces 21 and 23, equal amounts of heat are applied to each surface, thereby maintaining the surfaces at substantially the same temperature, thereby further reducing the risk of condensation from accumulating on one of the surfaces. It should be appreciated that the wires 25 could alternatively extend horizontally in accordance with an alternate embodiment.

In accordance with the preferred embodiment, heating assembly is placed between the tempered glass sections 26 and 28, which are adhesively attached to each other using an adhesive, such as PVB. It should be appreciated, however, that any alternative suitable windshield laminate having a heating assembly therein, and that is capable of maintaining the temperature of the inner and outer surfaces 29 and 31 greater than the dew point of the warmer environment may be used, as would be understood by one having ordinary skill in the art.

As will be described in more detail below, the bus bars 29 and 31 form part of a control circuit 36 which conducts current to the heating wires 25. As is well known in the art, the current flow through the wires 25 produces heat proportional to the resistance and the square of the current ($I^2*R$), and this heat is conducted relatively uniformly throughout the windshield assembly 22. As a result, the wires 25 are configured to supply heat to both layers 26 and 28 of the windshield assembly 22 to maintain the temperature of the inner surface 21 substantially the same as the temperature of the outer surface 23, thereby preventing condensation from accumulating on either surface of the assembly.

A first and second temperature sensor 30 and 37, respectively, are mounted at different locations on one of the surfaces of the windshield assembly 22. In particular, both sensors are mounted onto the inner surface 21 to detect the corresponding temperature thereof. The sensors 30 and 37 may comprise a pair of thermocouples, which output voltage in response to temperature input, thermistors, which output current in response to a temperature input, or resistance temperature detectors (RTDs), whose resistance varies as a function of temperature input. The sensors 30 and 37 are preferably spaced a sufficient distance apart to provide an indication of the coldest location on the windshield assembly 22, it being appreciated that the coldest location should be heated to a temperature greater than the dew point of the warmer environment to prevent the accumulation of condensation on the windshield assembly. In accordance with the preferred embodiment, the sensors 30 and 37 are disposed at opposite locations longitudinally on the windshield assembly 22. It should be appreciated, however, that the location of the sensors 30 and 38 may differ on the inner surface 21, and that the sensors could alternatively be placed on the outer surface 23. Furthermore, additional sensors could be placed on the windshield assembly 22 to enhance the accuracy of the control circuit.

Figure 3:
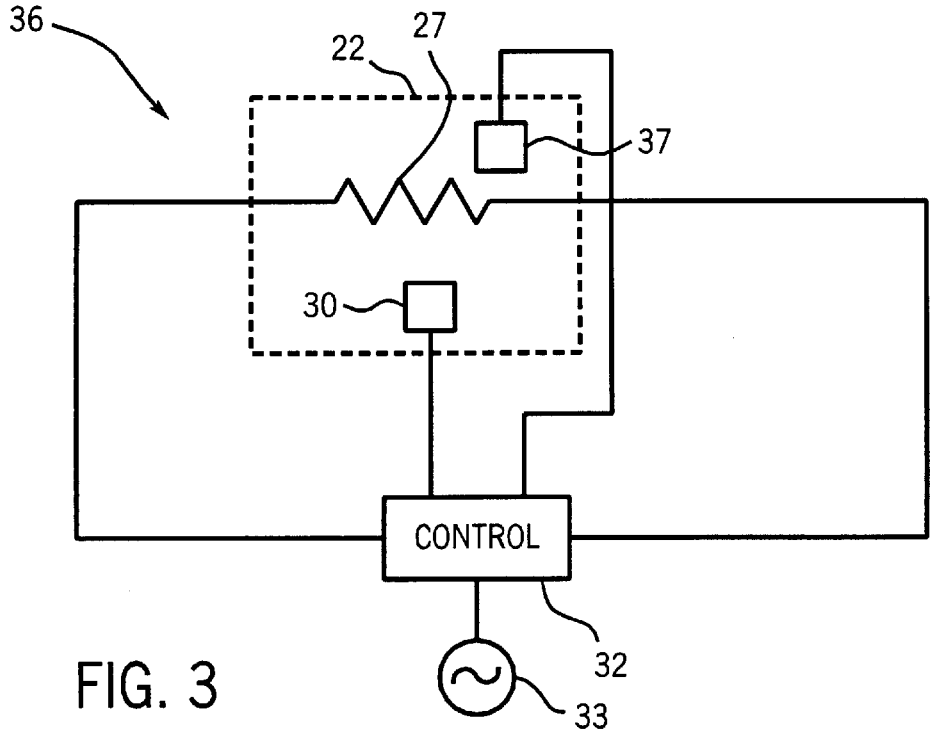
FIG. 3 is an electrical schematic diagram of a control circuit in accordance with a preferred embodiment of the invention.

Referring now also to FIG. 3, the control circuit 36 is schematically illustrated having an electrical control 32 that is mounted within the console station 12 and coupled to an electrical DC power source 33. The control 32 implemented in accordance with the preferred embodiment is commercially available from such suppliers as MINCO Products, Inc, under product designation CT293. The control 32 is further electrically connected in series with the heating assembly 27 (illustrated schematically as a resistor) to supply current thereto when the windshield assembly 22 requires heating. The control 32 is further connected to the temperature sensors 30 and 37 and, based on the output from the sensors, determines the temperature measurement of different locations on the inner surface 21.

During operation, the temperature sensors 30 and 37 sense and output the actual temperature of various locations on the windshield assembly 22 to the control 32 which, in turn, compares these indicated windshield temperatures to a desired temperature range. The control 32 then determines, based on the coldest of the indicated actual temperatures, whether or not to supply current to the heating assembly 27. In particular, the desired temperature range is defined by a proportional band having a set point, which is the maximum desired temperature. It is therefore desirable to choose a proportional band whose included temperatures are significantly greater than the dew point of the warm environment so as to ensure that condensation will not accumulate on the windshield assembly 22.

The control system 36 in accordance with the preferred embodiment is configured to prevent condensation from accumulating on the windshield assembly 22 under an extreme condition whereby the warm environment has a temperature of 90° and a relative humidity of 90%. Accordingly, it has been determined that a set point of 85 degrees Fahrenheit, and a proportion band of 5 degrees are suitable. The desired temperature range therefore includes those temperatures between 80 and 85 degrees Fahrenheit in accordance with the preferred embodiment. It should be appreciated, however, that these temperatures could differ substantially based on the ambient conditions of the warm environment.

In accordance with the preferred embodiment, when the control 32 determines that the temperature of the windshield assembly 22 is below the desired temperature range, as indicated by the colder of temperature sensors 30 and 37, current will be supplied to the heating assembly. The current will heat the copper wires 25, which will supply heat substantially equally to the first and second surfaces 21 and 23 of windshield assembly 22. As a result, the two surfaces 21 and 23 will be maintained at substantially the same temperature. Once both sensors 30 and 37 indicate that the temperature of the windshield is within the desired temperature range, the control 32 will produce a pulse width modulated signal having a duty cycle configured to maintain the temperature of the windshield assembly 22 within the desired temperature range. The duty cycle will decrease as the temperature of the windshield assembly 22 increases within the temperature range. If the temperature of the inner surface 21 becomes greater than the desired temperature range, for example when the truck is operating in the warm environment, the control 32 will discontinue the current supply until the inner surface is once again below the set point, thereby conserving energy.

The implementation of more than 1 sensor decreases the probability of condensation accumulating on a portion of the windshield assembly 22. It should be appreciated, as described above, that any number of sensors could be mounted onto the windshield assembly 22 if it is believed that the temperature will vary greatly at various locations on the windshield. For instance, a third or forth sensor could be mounted on the windshield assembly 22 for added security if so desired, it being appreciated that greater sensors increase the cost of the windshield assembly but increase the reliability of the control system 36.

The control 32 additionally compares the indicated temperatures from sensors 30 and 37 and, if the differential exceeds a maximum permissible differential, it will conclude that and an error condition exists. The predetermined differential could be any amount sufficient to indicate that an error exists and, in accordance with the preferred embodiment, the differential is chosen to be anywhere between 25 and 50 degrees Fahrenheit. In response to the error, the control 32 will discontinue current to the heating assembly 27, and may additionally activate an audible alarm or warning light (not shown). The operation of the first and second temperature sensors therefore 30 and 37 provides redundancy in determining the temperature of the windshield assembly, and allows the operator to determine if the control circuit, one of the temperature sensors, or the heating elements are not functioning properly.

The above has been described as a preferred embodiment of the present invention. It will occur to those that practice the art that many modifications may be made without departing from the spirit and scope of the invention. In order to apprise the public of the various embodiments that may fall within the scope of the invention, the following claims are made.

What is claimed is:

1. A man-operated vehicle configured to move between a first location having a cold storage temperature, and a second location having a dew point temperature greater than the cold storage temperature, the vehicle comprising:

a windshield member mounted onto said vehicle having first and second surfaces exposed to the ambient environment, wherein the first surface faces an operator console, and the second surface faces away from the operator console;

a heating assembly disposed within the windshield member and configured to supply heat thereto;

a first temperature sensor mounted onto the windshield member at a first location and being operable to output a first temperature signal indicating the temperature thereof;

a second temperature sensor mounted on to the windshield member at a second location different than the first location and being operable to output a second temperature signal indicating the temperature thereof; and a controller in electrical communication with the heating elements and the first and second temperature sensors and being operable to supply electrical power to the heating assembly when the either sensor indicates a temperature that is below a predetermined temperature level.

2. The vehicle as recited in claim 1, wherein the predetermined temperature level is a temperature greater than the dew point of the second location by a predetermined amount.

3. The vehicle as recited in claim 1, wherein the windshield member further comprises a laminate of two windshield sections having the heating elements disposed therebetween.

4. The vehicle as recited in claim 3, wherein the heating assembly comprises a plurality of wires extending throughout the windshield member and being disposed substantially equidistantly from the first and second surfaces.

5. The vehicle as recited in claim 4, wherein the first and second surfaces of the windshield member are maintained at substantially the same temperature.

6. The vehicle as recited in claim 1, wherein the controller compares the first and second temperature signals and supplies power when the coldest indicated temperature is below the predetermined temperature level.

7. The vehicle as recited in claim 1, wherein the controller is operable to discontinue the power when the first temperature signal differs from the second temperature signal by a predetermined amount.

8. The vehicle as recited in claim 7, wherein the power is discontinued when the temperature is within the range of 25 to 50 degrees Fahrenheit.

9. The vehicle as recited in claim 1, further comprising additional sensors disposed on the windshield member and electrically connected to the controller to provide additional corresponding temperature signals indicating the temperature of additional locations of the windshield member.

10. The vehicle as recited in claim 1, wherein the sensors are disposed on the first surface of the windshield member.

11. The vehicle as recited in claim 1, in which the vehicle is an open forklift truck.

12. A method for preventing condensation from accumulating on a windshield of an open, man operated, vehicle as it travels between a cold location and a warm location, wherein the warm location has a dew point temperature greater than the temperature of the cold location, the steps comprising:

(a) sensing the temperature of at least two locations on the windshield;

(b) applying electrical power to a heating assembly in the windshield to heat opposing first and second surfaces of the windshield when the temperature of at least one of the two locations is less than the dew point temperature; and (c) controlling the applied electrical power in response to the sensed windshield temperature to maintain the temperature of both the first and second surface at a level above the dew point temperature.

13. The method as recited in claim 12, wherein step (c) further comprises maintaining the first and second surfaces at substantially the same temperature.

14. The method as recited in claim 13, further comprising the step of discontinuing the applied electrical power if, in step (a), it is sensed that the temperature of the first and second surfaces differ by an amount between 25 and 50 Degrees Fahrenheit.

15. The method as recited in claim 12, wherein the vehicle comprises a forklift truck.

* * * * *